US005638037A

United States Patent [19]

Kurisu et al.

[11] Patent Number: 5,638,037

[45] Date of Patent: Jun. 10, 1997

[54] TM DUAL MODE DIELECTRIC RESONATOR AND FILTER UTILIZING DIFFERENT SIZE RESONATORS

[75] Inventors: Toru Kurisu, Kyoto; Hidekazu Wada, Ibaraki; Shin Abe, Mukou, all of Japan

[73] Assignee: Murata Manufacturing Co., Ltd., Japan

[21] Appl. No.: 534,311

[22] Filed: Sep. 27, 1995

Related U.S. Application Data

[62] Division of Ser. No. 365,295, Dec. 28, 1994, abandoned.

[30] Foreign Application Priority Data

Dec. 28, 1993 [JP] Japan ..... 5-351554
Dec. 28, 1993 [JP] Japan ..... 5-351555

[51] Int. Cl.[6] ..... H01P 1/20; H01P 7/10

[52] U.S. Cl. ..... 333/202; 333/219.1

[58] Field of Search ..... 333/202, 202 DB, 333/202 DR, 208, 219.1, 221, 235

[56] References Cited

FOREIGN PATENT DOCUMENTS 1058014 11/1983 U.S.S.R. ..... 333/202 DR

OTHER PUBLICATIONS

Ishikawa, Y. et al. "800 MHz High Power Duplexer Using TM Dual Mode Dielectric Resonators"; *1992 MTT-S Digest vol. 3;* 1–5 Jun. 1992 Albuquerque, N.M.; pp. 1617–1620.

Bezborodov, Y. M. et al. "Microwave Filters Using Cross-Shaped Dielectric Resonators"; *Telecommunications and Radio Engineering, vol. 39/40, No. 4*; Apr. 1985, Washington, US; pp. 121–123.

*Primary Examiner*—Benny Lee
*Assistant Examiner*—Barbara Summons
*Attorney, Agent, or Firm*—Ostrolenk, Faber, Gerb & Soffen, LLP

[57] ABSTRACT

In a TM dual mode dielectric resonator apparatus, a cross-shaped TM dual mode dielectric resonator is provided in an electrically conductive case, wherein the TM dual mode dielectric resonator comprises first and second dielectric resonators integrally formed so as to be perpendicular to each other, and coupling grooves for coupling an operation mode of the first dielectric resonator with an operation mode of the second dielectric resonator are formed in the TM dual mode dielectric resonator. Sizes such as thicknesses, widths or the like, of the first and second dielectric resonators are different from each other for adjusting the resonance frequency

20 Claims, 9 Drawing Sheets

TM DUAL MODE DIELECTRIC RESONATOR AND FILTER UTILIZING DIFFERENT SIZE RESONATORS

This is a division of application Ser. No. 08/365,295, filed Dec. 28, 1994, now abandoned.

BACKGROUND OF THE INVENTION

1. Field of the Invention

The present invention relates to a dielectric resonator apparatus and a high-frequency band-pass filter apparatus utilizing the dielectric resonator apparatuses, and in particular, to a TM dual mode dielectric resonator apparatus and a high-frequency band-pass filter apparatus utilizing the TM dual mode dielectric resonator apparatuses.

2. Description of the Related Art

FIG. 9 is a partially broken-away perspective view of a conventional high frequency four-stage band-pass filter apparatus 51, which comprises two single mode dielectric resonator 52 and 53 and one TM dual mode dielectric resonator 54 which are provided within a metal case 55.

Referring to FIG. 9, each of the single mode dielectric resonators 52 and 53 is constituted by providing a TM mode dielectric resonator 57 provided within an electrically conductive case 56 which functions as a waveguide. Further, the TM dual mode dielectric resonator 54 is constituted by providing within an electrically conductive case 61, a TM dual mode dielectric resonator 60 integrally formed in a shape of a cross of two TM mode dielectric resonators 58 and 59 so that the TM mode dielectric resonators 58 and 59 are perpendicular to each other, and the TM dual mode dielectric resonator 60 has coupling grooves 70 for coupling an operation mode of the even mode with that of the odd mode. The TM dual mode dielectric resonator 54 is disclosed in, for example, the Japanese Patent Laid-open Publication No. 61-121502.

In the conventional band-pass filter apparatus 51, a coupling loop 63, which is provided on the side of the inner surface of a coaxial input and output connector 62 provided on one end surface of a metal case 64 and which is electrically connected to the coaxial input and output connector 62, is magnetically coupled with the TM mode dielectric resonator (not shown) of the single mode dielectric resonator apparatus 52 of the first stage, which is magnetically coupled with the TM dual mode dielectric resonator 60, which provides the second and third stages. Further, the TM dual mode dielectric resonator 60 is magnetically coupled with the TM mode dielectric resonator 57 of the single mode dielectric resonator apparatus 53 of the final stage, which is magnetically coupled with another coupling loop (not shown) electrically connected to another coaxial input and output connector (not shown). This results in the four-stage band-pass filter apparatus 51.

By using a TM dual mode dielectric resonator, since the two TM mode dielectric resonators therein are integrally formed in a form of a cross, it is considered that the size of the filter apparatus can be reduced as compared with a case in which there are provided two single mode dielectric resonators. Therefore, in the above-mentioned four-stage band-pass filter apparatus, if two TM dual mode dielectric resonators can be utilized, rather than only one, it is expected that the size of the bandpass filter apparatus can be further reduced.

However, in the conventional TM dual mode dielectric resonator, the two TM mode dielectric resonators thereof have the same resonance frequency before they are installed within the filter apparatus. But when the TM dual mode dielectric resonator has been installed within the above-mentioned filter apparatus, and the TM dual mode dielectric resonator is coupled with the coupling loop, the resonance frequency of the one TM mode dielectric resonator thereof magnetically coupled with the coupling loop becomes different from that of the other TM mode dielectric resonator thereof not coupled with the coupling loop, due to the influence of the coupling loop. When the two TM mode dielectric resonators of the TM dual mode dielectric resonator have different resonance frequencies from each other, the coupling coefficient between the operation modes of the two rectangular-parallelepiped-shaped TM mode dielectric resonators of the TM dual mode dielectric resonator cannot be determined on the basis of the resonance frequency $f_{even}$ of the even mode and the resonance frequency $f_{odd}$ of the odd mode.

Accordingly, in the conventional apparatuses, as shown in the filter apparatus of FIG. 9, it is conventional to have single mode dielectric resonators 52 and 53 which are magnetically coupled with the coupling loops 63. In this case, the problem remains that the size of the conventional filter apparatus can not be further reduced.

SUMMARY OF THE INVENTION

The object of the present invention is therefore to provide a TM dual mode dielectric resonator apparatus, wherein respective resonance frequencies of two TM mode dielectric resonators thereof can be respectively adjusted so that the respective resonance frequencies of the two TM mode dielectric resonators become equal to each other when one TM mode dielectric resonator thereof is magnetically coupled with a coupling loop.

Another object of the present invention is to provide a high-frequency band-pass filter apparatus comprising two TM dual mode dielectric resonators each being magnetically coupled with a coupling loop, wherein respective resonance frequencies of two TM mode dielectric resonators of each TM dual mode dielectric resonator can be respectively adjusted so that the respective resonance frequencies of the two TM mode dielectric resonators become equal to each other when one TM mode dielectric resonator thereof is magnetically coupled with a coupling loop.

In order to achieve the aforementioned objective, according to one aspect of the present invention, a dielectric resonator apparatus comprises:

an electrically conductive case;

a cross-shaped TM dual mode dielectric resonator provided in said case, said TM dual mode dielectric resonator comprising first and second dielectric resonators integrally formed so as to be perpendicular to each other; and mode coupling means for coupling an operation mode of said first dielectric resonator with an operation mode of said second dielectric resonator, formed in said TM dual mode dielectric resonator;

wherein respective cross-sectional areas of said first and second dielectric resonators are different from each other.

According to another aspect of the present invention, in the dielectric resonator apparatus, other dimensions, such as thickness or widths, of said first and second dielectric resonators, are different from each other.

According to a still further aspect of the present invention, there is provided a high-frequency band-pass filter apparatus comprising:

first and second cross-shaped TM dual mode dielectric resonators, each provided in an electrically conductive case, each said TM dual mode dielectric resonator being one of the types described above;

first and second coupling loops provided in said case so that said first coupling loop is magnetically connected to said second dielectric resonator of said first TM dual mode dielectric resonator and said second coupling loop is magnetically connected to said second dielectric resonator of said second TM dual mode dielectric resonator; and a partition plate of a metal material having a plurality of slits formed therein so as to be parallel to said second dielectric resonators of said first and second TM dual mode dielectric resonators, said slits being provided for magnetically coupling said first dielectric resonator of said first TM dual mode dielectric resonator with said first dielectric resonator of said second TM dual mode dielectric resonator, wherein said cross-sectional areas or dimensions of said first and second dielectric resonators are set so as to be different from each other as described above so that resonance frequencies of said second dielectric resonators of said first and second TM dual mode dielectric resonators are equal to those of said first dielectric resonators thereof.

In the TM dual mode dielectric resonator apparatus, respective resonance frequencies of the two first and second TM mode dielectric resonators thereof can be adjusted so that the respective resonance frequencies of the two TM mode dielectric resonators become equal to each other when one TM mode dielectric resonator thereof is magnetically coupled with a coupling loop. Therefore, the TM dual mode dielectric resonator apparatus can be used in the stage that is to be coupled with the coupling loop. This results in reduction in the size of the high-frequency band-pass filter apparatus.

BRIEF DESCRIPTION OF THE DRAWINGS

These and other objects and features of the present invention will become clear from the following description of preferred embodiments thereof with reference to the accompanying drawings throughout which like parts are designated by like reference numerals (which may not be described in connection with all figures in which they appear), and in which.

DETAILED DESCRIPTION OF THE PREFERRED EMBODIMENTS

The preferred embodiments according to the present invention will be described below with reference to the attached drawings.

FIRST PREFERRED EMBODIMENT

Figure 1A:
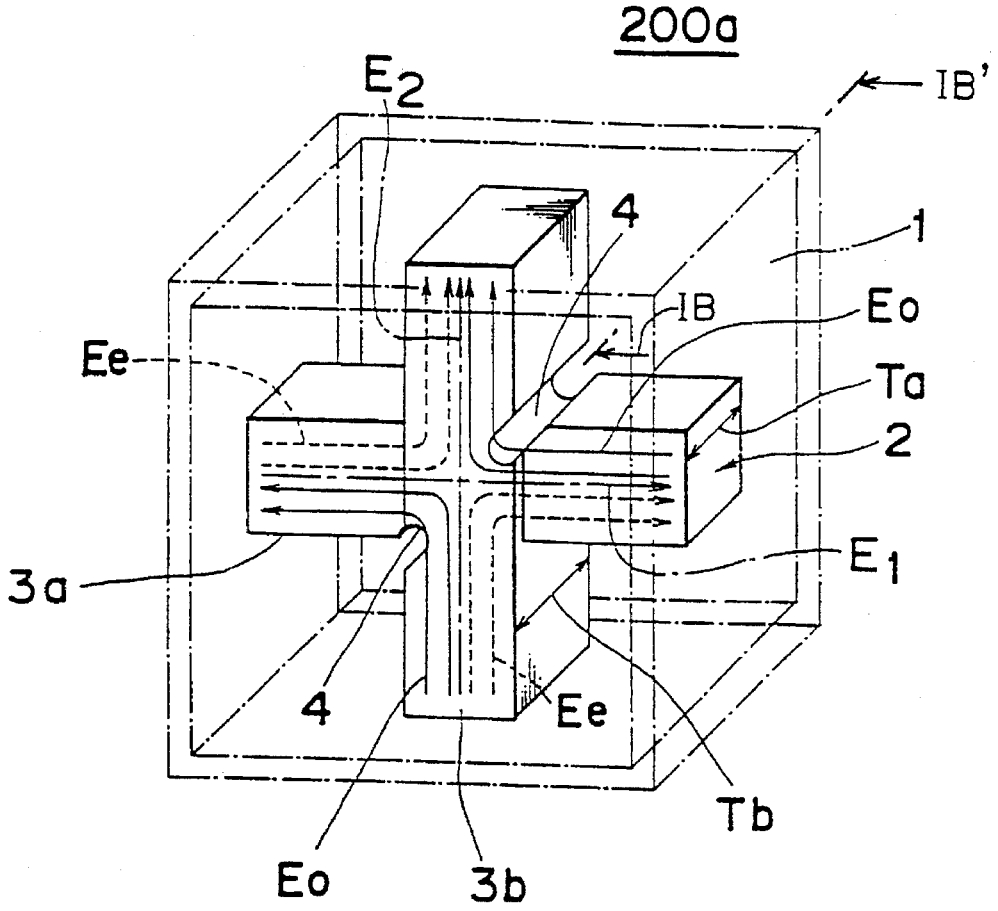
FIG. 1A is a perspective view of a TM dual mode dielectric resonator apparatus according to a first preferred embodiment of the present invention.
Figure 1B:
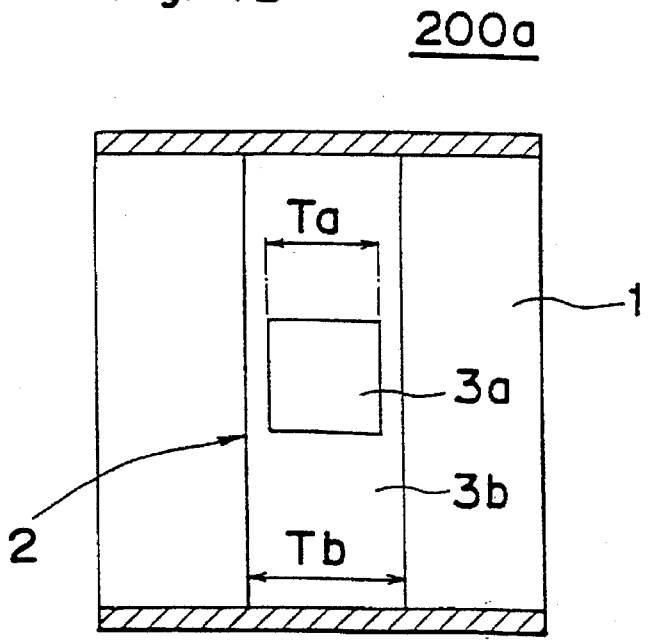
FIG. 1B is a cross-sectional view along a line IB—IB' of FIG. 1A.

FIG. 1A is a perspective view of a TM dual mode dielectric resonator apparatus **200*a* according to a first preferred embodiment of the present invention, and FIG. 1B is a cross-sectional view along a line IB–IB' of FIG. 1A**.

Referring to FIG. 1A, a dual mode dielectric resonator apparatus **200*a* is constituted by integrally providing a TM dual mode dielectric resonator 2 within a rectangular-prism-shaped electrically conductive case 1 which functions as a waveguide. The electrically conductive case 1 is constituted by a metal case, or by forming an earth electrode on surfaces of a case main body made of a dielectric ceramics material formed in a manner similar to that of the TM dual mode dielectric resonator 2 by plating the surfaces thereof with an Ag paste or the like. Further, the TM dual mode dielectric resonator 2 is integrally formed in a shape of a cross of two rectangular-prism-shaped TM mode dielectric resonators 3*a* and 3*b* made of a dielectric ceramic material each TM mode dielectric resonator having, for example, a $TM_{110}$ mode so that the TM mode dielectric resonators 3*a* and 3*b*** are perpendicular to each other.

In the present preferred embodiment, as shown in FIG. 1B, the respective TM mode dielectric resonators **3*a* and 3*b* are formed so that the thickness Tb in a depth direction from the front surface towards the back surface of one TM mode dielectric resonator 3*b* vertically installed is greater than the thickness Ta in the depth direction from the front surface towards the back surface of another TM mode dielectric resonator 3*a* horizontally installed. In the case 1 made of a metal material, the TM dual mode dielectric resonator 2 is electrically and mechanically coupled with the inner surfaces of the case 1 through electrically conductive layers (not shown) of Ag thick films formed on both end surfaces of each of the respective TM mode dielectric resonators 3*a* and 3*b***.

As shown in FIG. 1A, the following electric lines of force are generated in the TM dual mode dielectric resonator 2:

(a) electric lines $E_1$ and $E_2$ of force of the respective dielectric resonators **3*a* and 3*b*** indicated by alternate long and short dash lines;

(b) electric lines Ee of force of the even mode indicated by dotted lines; and (c) the other electric lines Eo of force of the odd mode indicated by solid lines.

In the top right corner and the bottom left corner of a crossing portion where the two TM mode dielectric resonators 3a and 3b (referred to as a crossing portion hereinafter) are connected in a shape of a cross to form the TM dual mode dielectric resonator 2, coupling grooves 4 for coupling an operation mode or a resonance oscillation of the TM mode dielectric resonator 3a with that of the TM mode dielectric resonator 3b are formed so as to extend from the front surface of the crossing portion towards the back surface thereof and so as to have depths in a diagonal direction of the crossing portion, respectively. The coupling grooves 4 are formed in order to cut the electric lines Eo of force of the odd mode. The coupling coefficient between the two TM mode dielectric resonators 3a and 3b can be adjusted by adjusting the depths and/or widths of the coupling grooves 4.

The coupling grooves 4 may alternatively be formed in the top left corner and the bottom right corner of the crossing portion of the two TM mode dielectric resonators 3a and 3b so as to cut the electric lines Ee of force of the even mode.

In the present preferred embodiment, since the thickness Tb of the TM mode dielectric resonator 3b vertically installed is greater than the thickness Ta of the TM mode dielectric resonator 3a horizontally installed, the effective dielectric constant of the TM mode dielectric resonator 3b becomes greater than that of the TM mode dielectric resonator 3a. In this case, the resonance frequency of the TM mode dielectric resonator 3b is lower than that of the TM mode dielectric resonator 3a.

The use of the TM dual mode dielectric resonator apparatus 200a which is formed so that the respective thickness of the TM mode dielectric resonators 3a and 3b are different from each other, as described above, results in a difference between the resonance frequencies of the TM mode dielectric resonators 3a and 3b. The present preferred embodiment of the present invention utilizes this phenomenon. Therefore, the difference between the thicknesses of the respective TM mode dielectric resonators 3a and 3b can reduce or eliminate the difference between the resonance frequencies of the TM mode dielectric resonators 3a and 3b, which are formed so as to cross each other perpendicularly.

For example, when one TM mode dielectric resonator, for example, 3b is magnetically coupled with a coupling loop, the resonance frequency of the TM mode dielectric resonator 3b is shifted from the original resonance frequency thereof so as to be higher than the original resonance frequency thereof due to the magnetic coupling. In this case, this shift in the resonance frequency of the TM mode dielectric frequency 3b can be corrected so as to be zero, by adjusting the thickness Tb of the TM mode dielectric resonator 3b so as to be greater than the thickness Ta of the TM mode dielectric resonator 3a. Thus, with one TM mode dielectric resonator 3b being coupled with a coupling loop, the respective resonance frequencies of the TM mode dielectric resonators 3a and 3b can be set to be equal to each other through the above-mentioned adjustment.

When the depths or widths of the coupling grooves 4 are changed, the coupling coefficient between the TM mode dielectric resonators 3a and 3b can be adjusted. In this case, when the respective resonance frequencies of the TM mode dielectric resonators 3a and 3b are adjusted so as to be equal to each other, the coupling coefficient can be determined or calculated based on the resonance frequency $f_{even}$ of the even mode and the resonance frequency $f_{odd}$ of the odd mode.

The respective TM mode dielectric resonator 2 may alternatively be formed so that the thickness Tb of the TM mode dielectric resonator 3b is smaller than the thickness Ta of the TM mode dielectric resonator 3a.

SECOND PREFERRED EMBODIMENT

Figure 2:
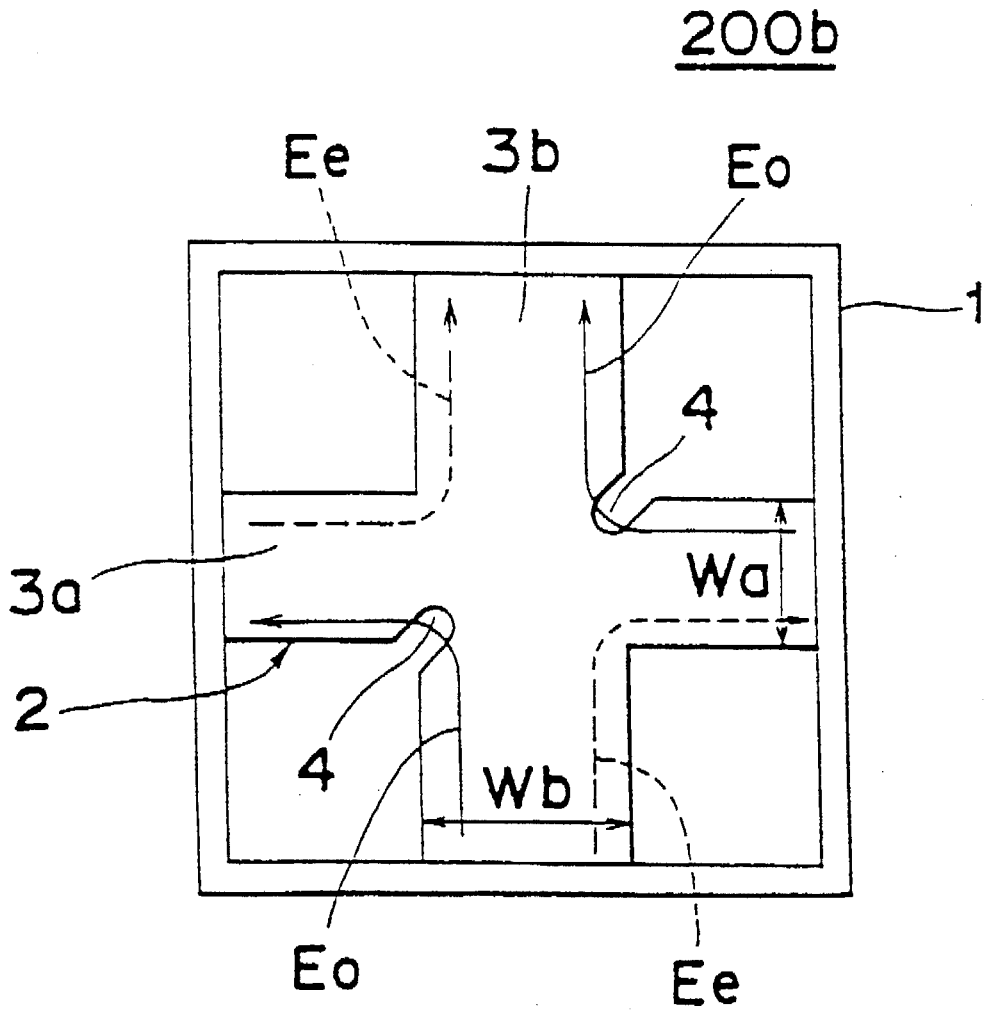
FIG. 2 is a front view of a TM dual mode dielectric resonator apparatus according to a second preferred embodiment of the present invention.

FIG. 2 is a front view of a TM dual mode dielectric resonator apparatus 200b according to a second preferred embodiment of the present invention;

Referring to FIG. 2, in the TM dual mode dielectric resonator apparatus 200b, the TM dual mode dielectric resonator 2 is constituted by a pair of TM mode dielectric resonators 3a and 3b which are formed so that the width Wb on the front and back surfaces of the TM mode dielectric resonator 3b vertically installed is greater than the width Wa on the front and back surfaces of the TM mode dielectric resonator 3a. This results in that the effective dielectric constant of the TM mode dielectric resonator 3b vertically installed becomes greater than that of the TM mode dielectric resonator 3a horizontally installed. As a result, the resonance frequency of the TM mode dielectric resonator 3b becomes lower than that of the TM mode dielectric resonator 3a.

In a modified embodiment, the respective resonance frequencies of the TM mode dielectric resonators 3a and 3b may be adjusted by setting both the thicknesses in the depth direction and the widths of the two TM mode dielectric resonators 3a and 3b so that the thicknesses thereof are different from each other and the widths thereof are different from each other. Furthermore, in another modification using circular-cylindrical TM mode dielectric resonators 3a and 3b, the diameters thereof may be different from each other. In other words, the cross-sectional areas of the two TM mode dielectric resonators 3a and 3b may be different from each other. In this case, the same advantageous effects can be obtained as that of the above-mentioned case.

Even though each of the two TM mode dielectric resonators 3a and 3b has an elongated slot or a space therein and they have the same depths and the same widths, the cross-sectional areas of the two TM mode dielectric resonators 3a and 3b may be different from each other. In this case, the same advantageous effects can be obtained as that of the above-mentioned case.

THIRD PREFERRED EMBODIMENT

Figure 3:
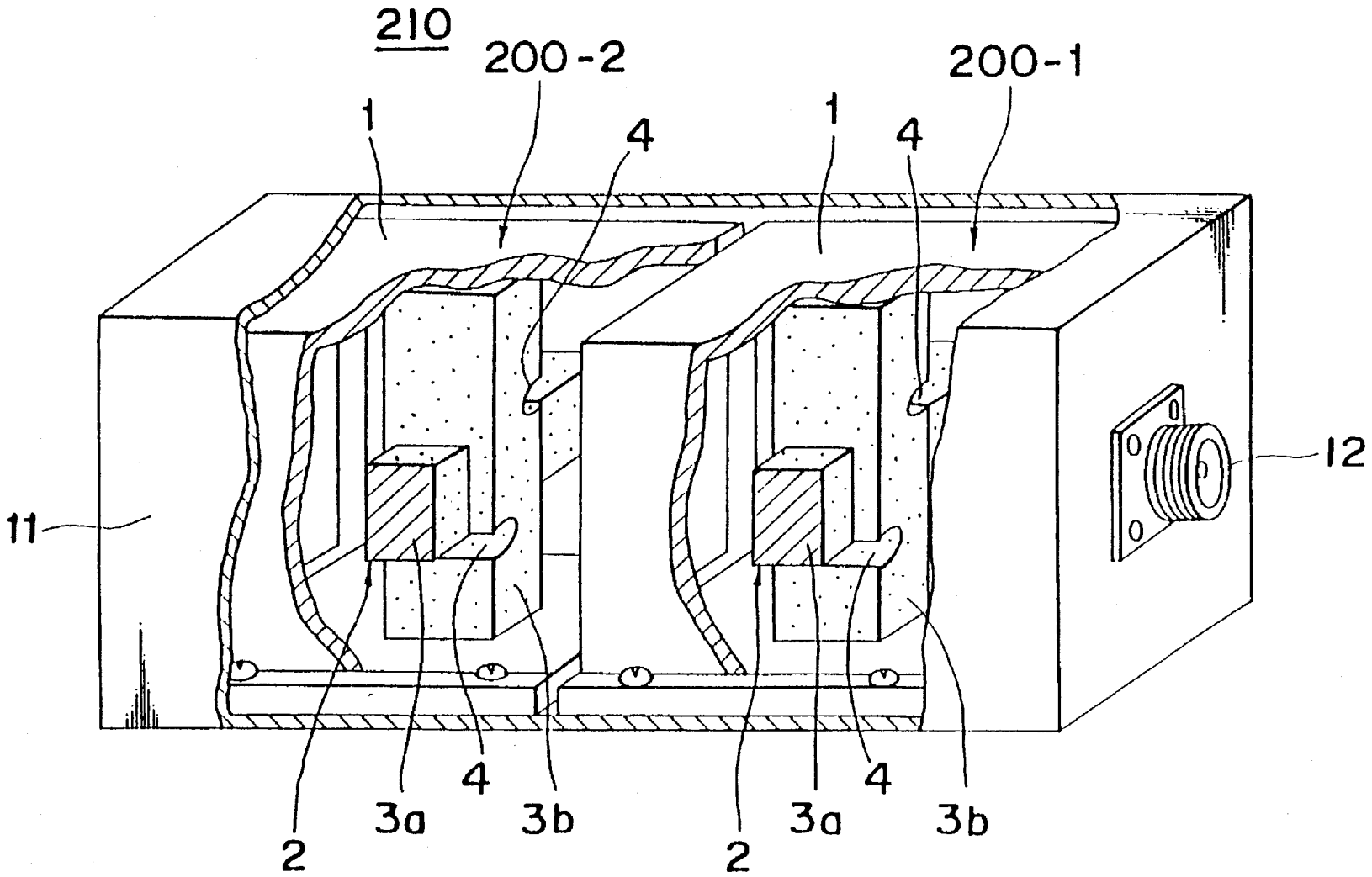
FIG. 3 is a partially broken-away perspective view of a high frequency four-stage band-pass filter apparatus according to a third preferred embodiment of the present invention.
Figure 4:
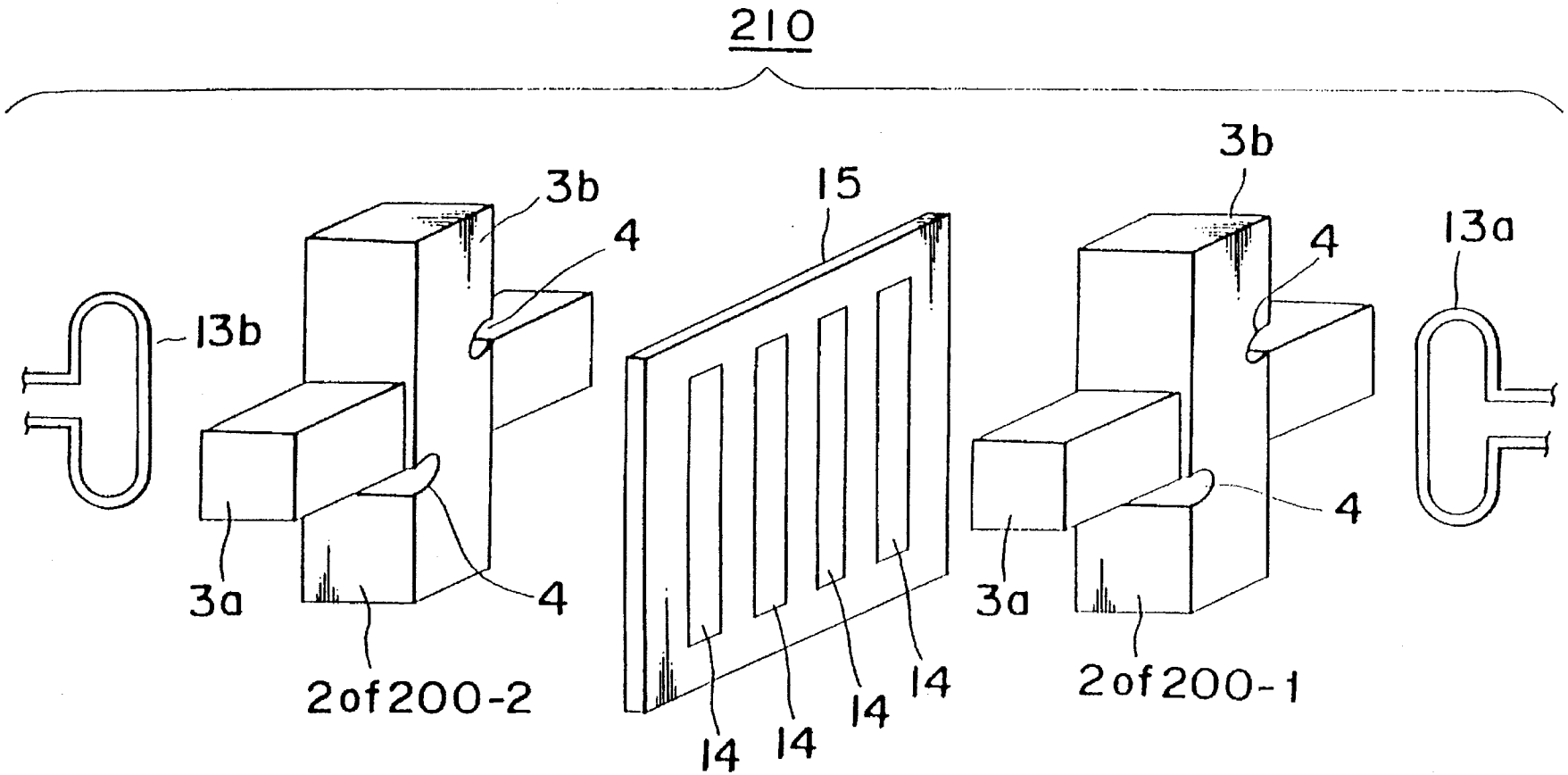
FIG. 4 is an exploded view showing main portions of the high frequency four-stage band-pass filter apparatus shown in FIG. 3.

FIG. 3 is a partially broken-away perspective view of a high frequency four-stage band-pass filter apparatus 210 according to a third preferred embodiment of the present invention, and FIG. 4 is an exploded view showing main portions of the high frequency four-stage band-pass filter apparatus 210 shown in FIG. 3.

Referring to FIG. 3, within a rectangular-shaped metal case 11, two TM dual mode dielectric resonator apparatuses 200-1 and 200-2 having a structure shown in FIGS. 1A and 1B (or the structure of FIG. 2 may also be used) are provided so as to be spaced apart and so that the front and back surfaces of the crossing portions thereof are parallel to each other.

As shown in FIGS. 3 and 4, the TM mode dielectric resonator 3b vertically installed of the TM dual mode dielectric resonator apparatus 200-1 is magnetically coupled with a coupling loop 13a electrically connected to a coaxial input and output connector 12 provided in the case 11, whereas the TM mode dielectric resonator 3b vertically installed of the TM dual mode dielectric resonator apparatus 200-2 is magnetically coupled with a coupling loop 13b electrically connected to another coaxial input and output connector (not shown) provided in the case 11. Between the two TM dual mode dielectric resonator apparatuses 200-1 and 200-2, there is provided a partition plate 15 of a metal material having an electrode pattern formed thereon, and having a plurality of strip-shaped slits 14 which are parallel to each other and to the longitudinal directions of the TM mode dielectric resonators 3b of the TM dual mode dielectric resonators 200-1 and 200-2 and which are formed vertically. Then the TM mode dielectric resonator 3a of the TM dual mode dielectric resonators 200-1 is magnetically coupled with the TM mode dielectric resonator 3a of the TM dual mode dielectric resonators 200-2 through the slits 14 of the partition plate 15.

In the preferred embodiment, the TM dual mode dielectric resonator apparatuses 200-1 and 200-2 are provided at stages where they are coupled with the coupling loops 13a and 13b, and the resonance frequencies of the TM mode dielectric resonators 3b coupled with the coupling loops 13a and 13b are influenced thereby. In the high-frequency band-pass filter apparatus 210, the respective resonance frequencies of the TM mode dielectric resonator 3a not coupled with the coupling loop 13a or 13b and the TM mode dielectric resonator 3b coupled with the coupling loop 13a or 13b can be adjusted so as to be the same as each other by adjusting the thickness of each of the TM mode dielectric resonators 3b. Therefore, the coupling coefficient can be adjusted to a desirable value based on the resonance frequency $f_{even}$ of the even mode and the resonance frequency $f_{odd}$ of the odd mode. Accordingly, a TM dual mode dielectric resonator apparatus can be provided at a stage where it is coupled with the coupling loop 13a or 13b. This results in reduction in the size and the weight of the high-frequency band-pass filter apparatus 210.

FOURTH PREFERRED EMBODIMENT

Figure 5A:
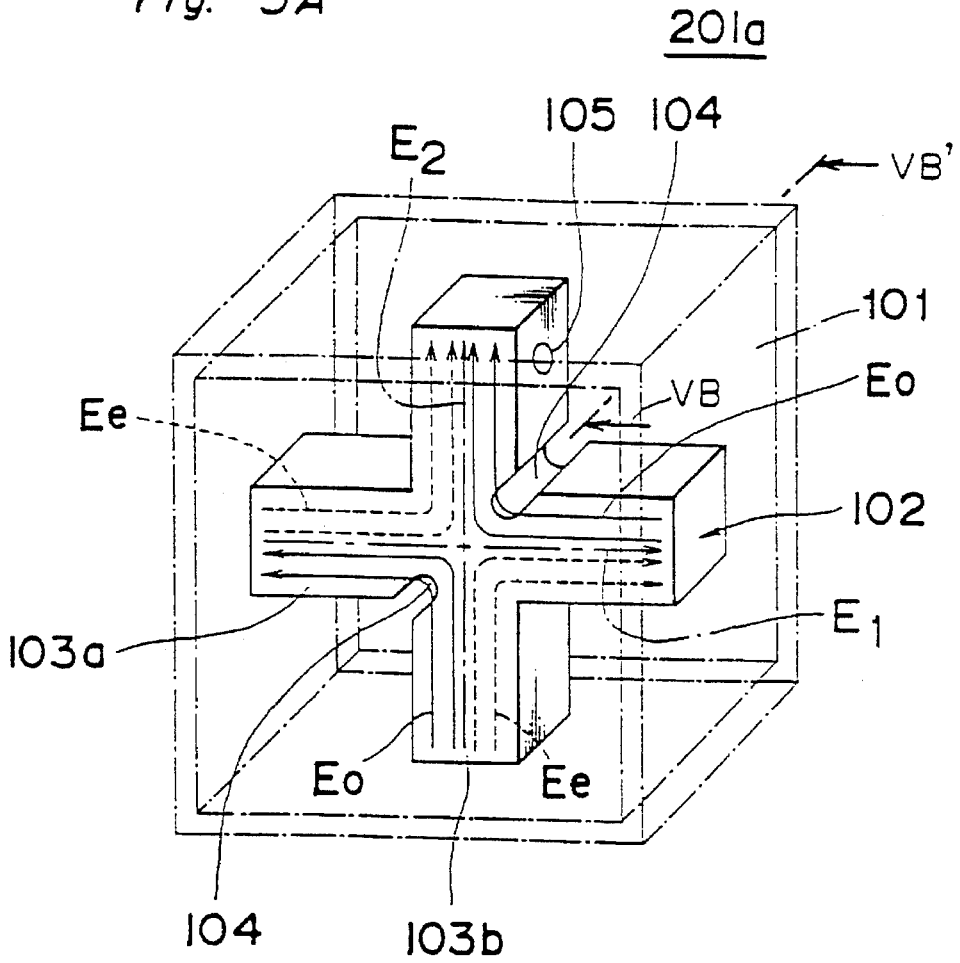
FIG. 5A is a perspective view of a TM dual mode dielectric resonator apparatus according to a fourth preferred embodiment of the present invention.
Figure 5B:
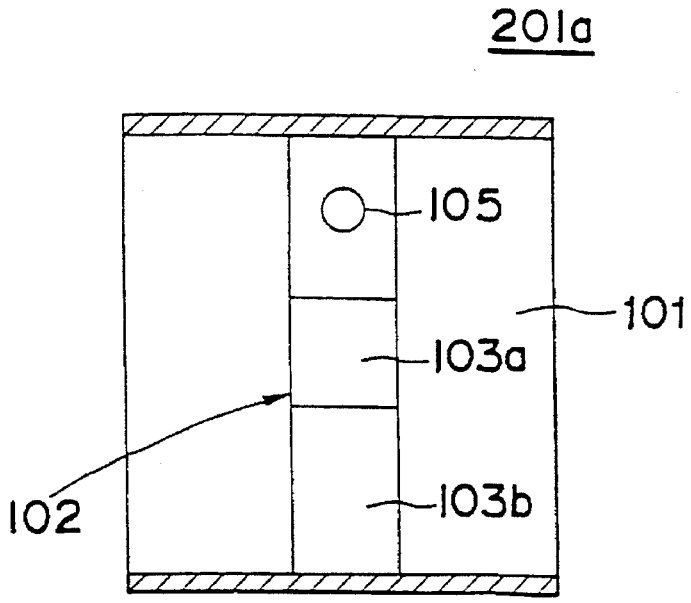
FIG. 5B is a cross-sectional view along a line VB–VB' of FIG. 5A.

FIG. 5A is a perspective view of a TM dual mode dielectric resonator apparatus 201a according to a fourth preferred embodiment of the present invention, and FIG. 5B is a cross-sectional view along a line VB–VB' of FIG. 5A.

Referring to FIG. 5A, a dual mode dielectric resonator apparatus 201a is constituted by integrally providing a TM dual mode dielectric resonator 102 within a rectangular-prism-shaped electrically conductive case 101 which functions as a waveguide. The electrically conductive case 101 is constituted by a metal case, or by forming an earth electrode on surfaces of a case main body made of a dielectric ceramics material in a manner similar to that of the TM dual mode dielectric resonator 102 by plating the surfaces thereof with a Ag paste or the like. Further, the TM dual mode dielectric resonator 102 is integrally formed in a shape of a cross of two rectangular-prism-shaped TM mode dielectric resonators 103a and 103b made of a dielectric material, each TM mode dielectric resonator having, for example, a $TM_{110}$ mode so that the TM mode dielectric resonators 103a and 103b are perpendicular to each other. It is to be noted that the width and depth of the TM mode dielectric resonator 103a are the same as those of the TM mode dielectric resonator 103b.

In the case 101 made of a metal material, the TM dual mode dielectric resonator 102 is electrically and mechanically coupled with the inner surfaces of the case 101 through electrically conductive layers (not shown) of Ag thick films formed on both the end surfaces of the respective TM mode dielectric resonators 103a and 103b.

As shown in FIG. 5A, the following electric lines of force are generated in the TM dual mode dielectric resonator 102:

(a) electric lines $E_1$ and $E_2$ of force of the respective dielectric resonators 103a and 103b indicated by alternate long and short dash lines;

(b) electric lines Ee of force of the even mode indicated by dotted lines; and (c) the other electric lines Eo of force of the odd mode indicated by solid lines.

In the top right corner and the bottom left corner of a crossing portion of the two TM mode dielectric resonators 103a and 103b(referred to as a crossing portion hereinafter) formed in a shape of the cross of the TM dual mode dielectric resonator 102, coupling grooves 104 for coupling an operation mode or a resonance oscillation of the TM mode dielectric resonator 103a with that of the TM mode dielectric resonator 103b are formed so as to extend from the front surface of the crossing portion towards the back surface thereof and so as to have depths in a diagonal direction of the crossing portion, respectively. The coupling grooves 104 are formed in order to cut the electric lines Eo of force of the odd mode. The coupling coefficient between the two TM mode dielectric resonators 103a and 103b can be adjusted by adjusting the depths and/or widths of the coupling grooves 104.

In the present preferred embodiment, as shown in FIG. 5B, at the end of one TM mode dielectric resonator 103b among the two TM mode dielectric resonators 103a and 103b integrally formed so as to be perpendicular to each other, a circular-cylindrical hole 105 for adjusting the resonance frequency is formed so as to penetrate the end of the TM mode dielectric resonator 103b from the right side surface thereof to the left side surface thereof.

Where there is formed no hole 105, the resonance frequencies of the TM mode dielectric resonators 103a and 103b are the same as each other. However, when the hole 105 is formed in the TM mode dielectric resonator 103b, or when the diameter or size of the hole 105 is made greater, the effective dielectric constant of the TM mode dielectric resonator 103b becomes smaller than that of the TM mode dielectric resonator 103a. Then the resonance frequency of the TM mode dielectric resonator 103b becomes higher than that of the TM mode dielectric resonator 103a.

Figure 6:
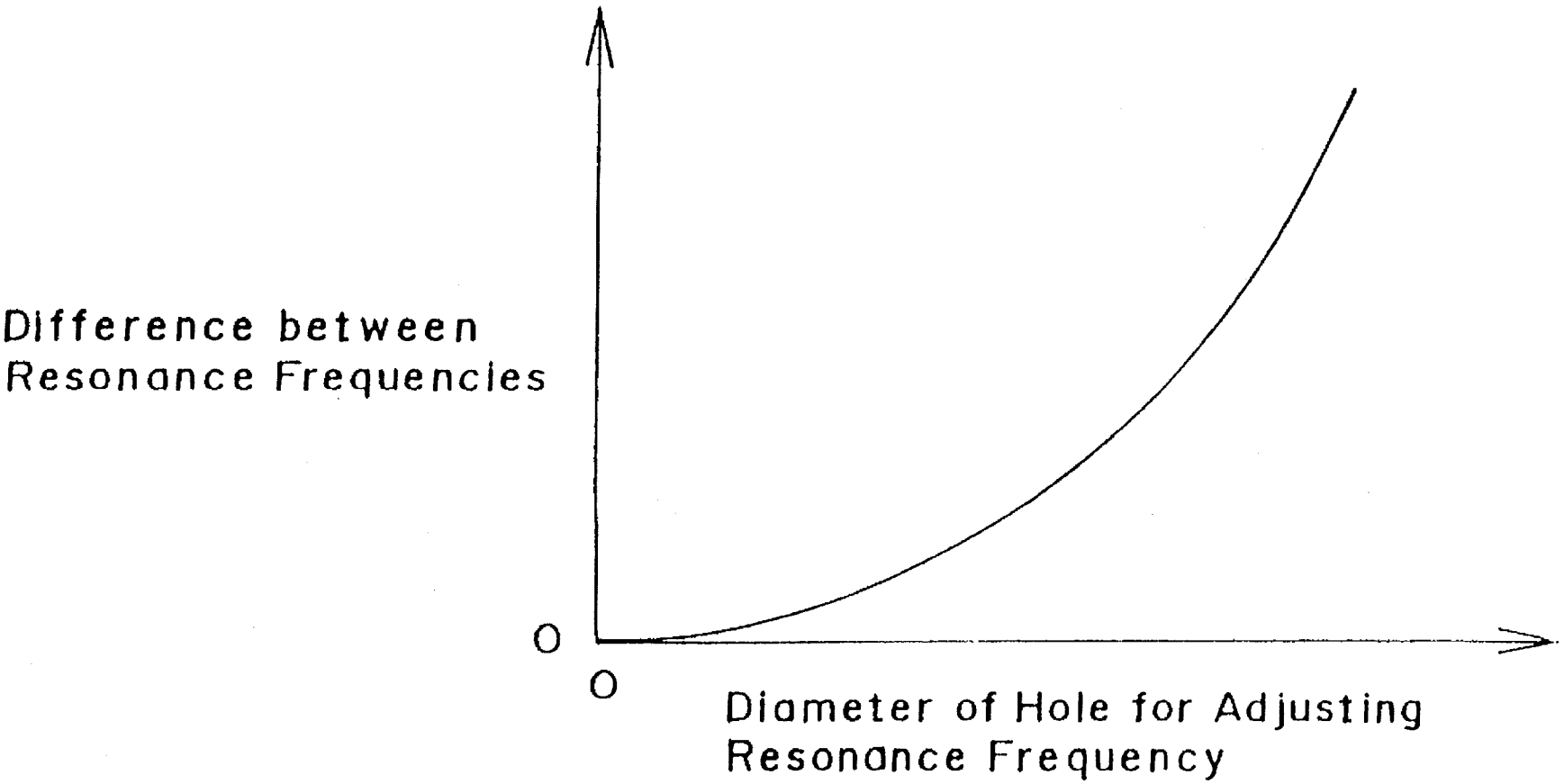
FIG. 6 is a graph showing a relationship between a difference between the respective resonance frequencies of the two TM mode dielectric resonators of the TM dual mode dielectric resonator shown in FIGS. 5A and 5B and a diameter of a hole for adjusting the resonance frequency formed in one TM mode dielectric resonator.

FIG. 6 shows a relationship between the difference between the resonance frequencies of the TM mode dielectric resonators 103a and 103b of the TM dual mode dielectric resonator 102 shown in FIGS. 5A and 5B, and the diameter of the hole 105 for adjusting the resonance frequency. As is apparent from FIG. 6, as the diameter or size of the hole 105 is greater, the difference between the resonance frequencies of the TM mode dielectric resonators 103a and 103b is greater.

In the TM dual mode dielectric resonator apparatus 201a wherein there is formed the hole 105 for adjusting the resonance frequency, there is a difference between the resonance frequencies of the TM mode dielectric resonators 103a and 103b. The present preferred embodiment of the present invention utilizes this phenomenon. Therefore, forming the hole 105 for adjusting the resonance frequency can correct the difference between the resonance frequencies of the TM mode dielectric resonators 103a and 103b, which are formed so as to cross each other perpendicularly Further, when one TM mode dielectric resonator, for example, 103a is magnetically coupled with a coupling loop, the resonance frequency of the TM mode dielectric resonator 103a is shifted from the original resonance frequency thereof so as to be higher than the original resonance frequency thereof through the magnetic coupling. In this case, the resonance frequency of the TM mode dielectric resonator 103b can be made higher than the original resonance frequency by forming the hole 105 for adjusting the resonance frequency in another TM mode dielectric resonator 103b. Further, by adjusting the diameter or size of the hole 105 for adjusting the resonance frequency, for example, when one TM mode dielectric resonator 103b is magnetically coupled with a coupling loop, the respective resonance frequencies of the TM mode dielectric resonators 103a and 103b can be set to be equal to each other.

When the depths or widths of the coupling grooves 104 are changed, the coupling coefficient between the TM mode dielectric resonators 103*a* and 103*b* can be adjusted. In this case, when the respective resonance frequencies of the TM mode dielectric resonators 103*a* and 103*b* are adjusted so as to be equal to each other, the coupling coefficient can be determined or calculated based on the resonance frequency $f_{even}$ of the even mode and the resonance frequency $f_{odd}$ of the odd mode.

In the preferred embodiment, the hole 105 may be formed at the end of the TM mode dielectric resonator 103*a*.

FIFTH PREFERRED EMBODIMENT

Figure 7:
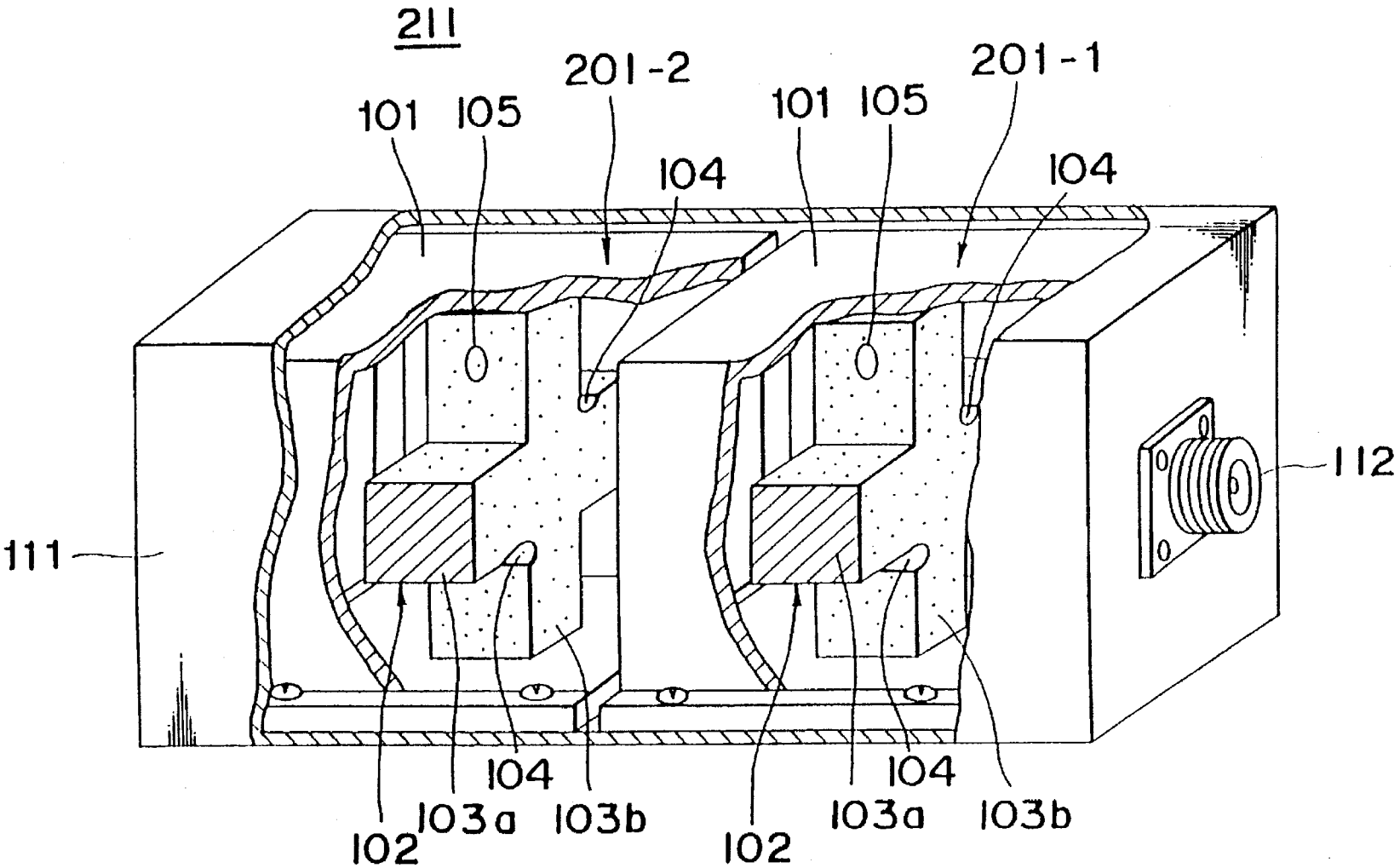
FIG. 7 is a partially broken-away perspective view of a high frequency four-stage band-pass filter apparatus according to a fifth preferred embodiment of the present invention.
Figure 8:
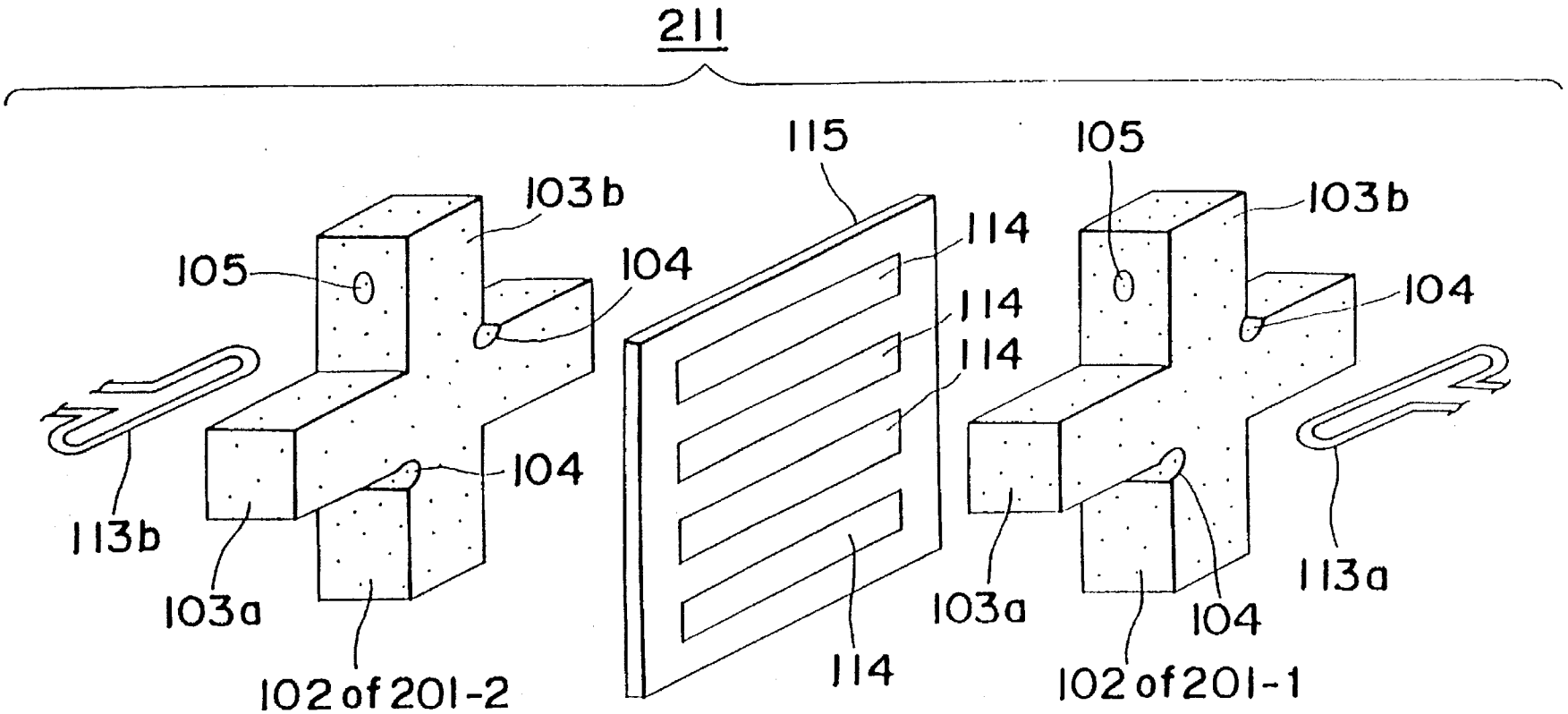
FIG. 8 is an exploded view showing main portions of the high frequency four-stage band-pass filter apparatus shown in FIG. 7.
Figure 9:
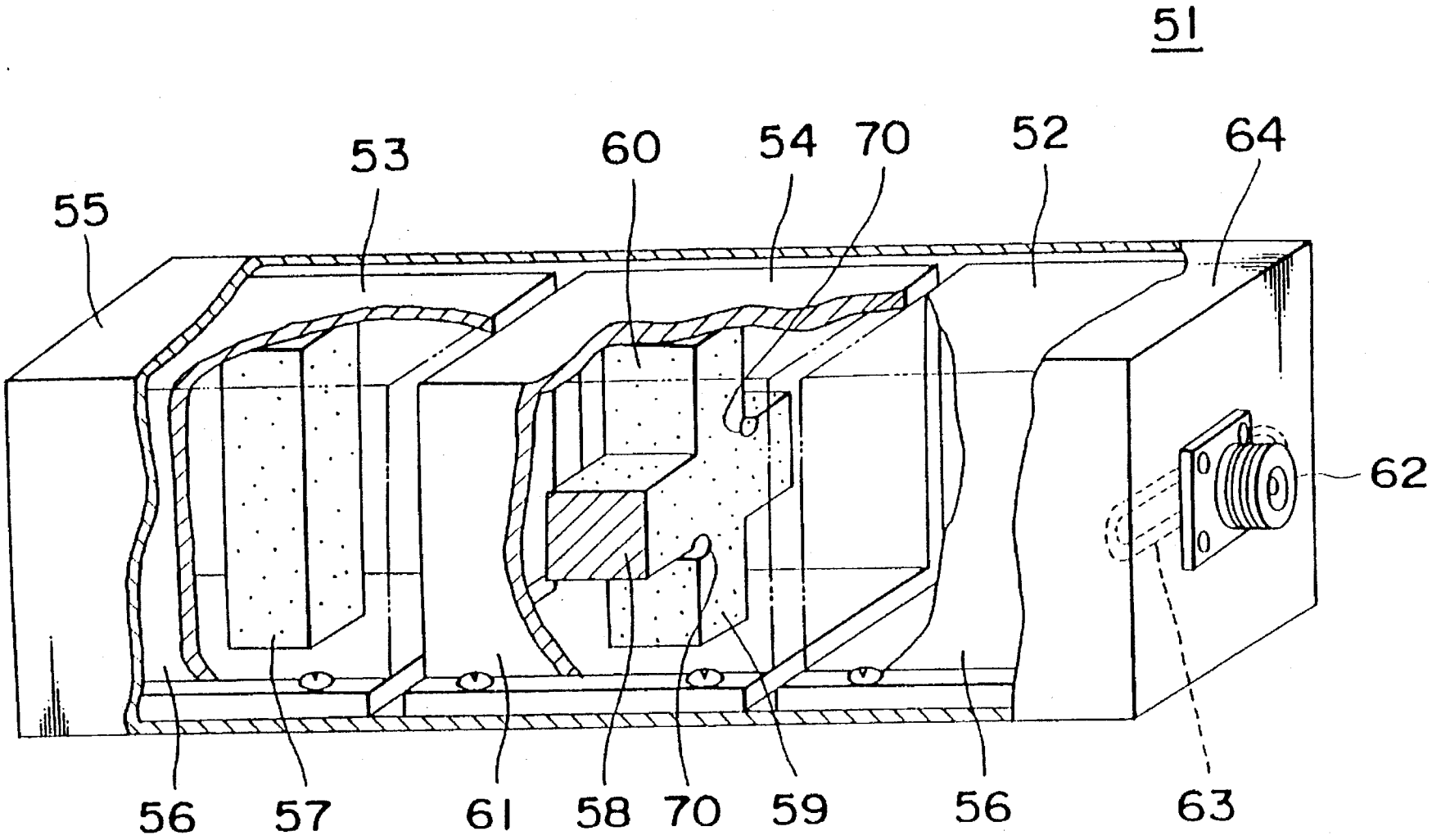
Fig. 9 PRIOR ART
FIG. 9 is a partially broken-away perspective view of a conventional high frequency four-stage band-pass filter apparatus.

FIG. 7 is a partially broken-away perspective view of a high frequency four-stage band-pass filter apparatus 211 according to a fifth preferred embodiment of the present invention, and FIG. 8 is an exploded view showing main portions of the high frequency four-stage band-pass filter apparatus shown in FIG. 7.

Referring to FIG. 7, within a rectangular-cylindrical metal case 111, two TM dual mode dielectric resonator apparatuses 201-1 and 201-2 each having a structure shown in FIGS. 5A and 5B are provided so as to be spaced apart and so that the front and back surfaces of the crossing portions thereof are parallel to each other.

As shown in FIGS. 7 and 8, the TM mode dielectric resonator 103*a* horizontally installed of the TM dual mode dielectric resonator apparatus 201-1 is magnetically coupled with a coupling loop 113*a* electrically connected to a coaxial input and output connector 112 provided in the case 111, whereas the TM mode dielectric resonator 103*a* horizontally installed of the TM dual mode dielectric resonator apparatus 201-2 is magnetically coupled with a coupling loop 113*b* electrically connected to another coaxial input and output connector (not shown) provided in the case 111. Between the two TM dual mode dielectric resonator apparatuses 201-1 and 201-2, there is provided a partition plate 115 of a metal material having an electrode pattern formed thereon, and having a plurality of strip-shaped slits 114 which are parallel to each other and to the longitudinal directions of the TM mode dielectric resonators 103*a* of the TM dual mode dielectric resonators 201-1 and 201-2 and which are formed horizontally. Then the TM mode dielectric resonator 103*b* of the TM dual mode dielectric resonators 201-1 is magnetically coupled with the TM mode dielectric resonator 103*b* of the TM dual mode dielectric resonators 201-2 through the slits 114 of the partition plate 115.

In the preferred embodiment, the TM dual mode dielectric resonator apparatuses 201-1 and 201-2 are provided at the stages where they are coupled with the coupling loops 113*a* and 113*b*, and the resonance frequencies of the TM mode dielectric resonators 103*a* coupled with the coupling loops 113*a* and 113*b* are influenced thereby. In the high-frequency band-pass filter apparatus 211, the respective resonance frequencies of the TM mode dielectric resonator 103*b* not coupled with the coupling loop 113*a* or 113*b* and the TM mode dielectric resonator 103*a* coupled with the coupling loop 113*a* or 113*b* can be adjusted so as to be the same as each other by adjusting the diameter or size of the holes 105 for adjusting the resonance frequency which is formed in the TM mode dielectric resonators 103*b*. Therefore, the coupling coefficient can be adjusted to a desirable value based on the resonance frequency $f_{even}$ of the even mode and the resonance frequency $f_{odd}$ of the odd mode. Accordingly, the TM dual mode dielectric resonator apparatus can be coupled with the coupling loop 113*a* or 113*b*. This results in reduction in the size and the weight of the high-frequency band-pass filter apparatus 211.

Furthermore, the shift of the resonance frequency between the TM mode dielectric resonators 103*a* and 103*b* due to coupling between the TM mode dielectric resonators 103*a* and 103*b* which are formed so as to be perpendicular to each other can be corrected to be zero in a similar manner.

According to the TM dual mode dielectric resonator apparatus of the preferred embodiments of the present invention, the respective resonance frequencies of the two TM mode dielectric resonators thereof can be adjusted to be equal to each other although one TM mode dielectric resonator thereof is magnetically coupled with a coupling loop. Therefore, the TM dual mode dielectric resonator apparatus can be used in a stage where it is coupled with the coupling loop. This results in reduction in the size of the high-frequency band-pass filter apparatus.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A dielectric resonator apparatus comprising:

an electrically conductive case;

a cross-shaped TM dual mode dielectric resonator provided in said case, said TM dual mode dielectric resonator comprising first and second dielectric resonators integrally formed so as to be perpendicular to each other; and a mode coupling structure which couples an operation mode of said first dielectric resonator with an operation mode of said second dielectric resonator, formed in said TM dual mode dielectric resonator;

wherein respective dimensions of said first and second dielectric resonators are different from each other;

wherein said dimensions are thicknesses of said first and second dielectric resonators; and wherein each of said first and second resonators has an elongated shape and two ends, and each of said first and second resonators respectively, has a substantially constant thickness and a substantially constant width from end to end.

2. The dielectric resonator apparatus, as claimed in claim 1, wherein said mode coupling structure is a mode coupling means.

3. The dielectric resonator apparatus, as claimed in claim 1, wherein said mode coupling structure comprises at least one coupling groove formed in a crossing portion of said first and second dielectric resonators.

4. The dielectric resonator apparatus, as claimed in claim 3, wherein said at least one coupling groove and a second coupling groove are formed in opposite portions of said crossing portion.

5. The dielectric resonator apparatus, as claimed in claim 1, wherein each said dielectric resonator is shaped as a substantially regular rectangular prism.

6. A dielectric resonator apparatus comprising:

an electrically conductive case;

a cross-shaped TM dual mode dielectric resonator provided in said case, said TM dual mode dielectric resonator comprising first and second dielectric resonators integrally formed so as to be perpendicular to each other; and a mode coupling structure which couples an operation mode of said first dielectric resonator with an operation mode of said second dielectric resonator, formed in said TM dual mode dielectric resonator;

wherein respective dimensions of said first and second dielectric resonators are different from each other;

wherein said dimensions are widths of said first and second dielectric resonators; and wherein each of said first and second resonators has an elongated shape and two ends, and each of said first and second resonators respectively, has a substantially constant thickness and a substantially constant width from end to end.

7. The dielectric resonator apparatus, as claimed in claim 6, wherein said mode coupling structure is a mode coupling means.

8. The dielectric resonator apparatus, as claimed in claim 6, wherein said mode coupling structure comprises at least one coupling groove formed in a crossing portion of said first and second dielectric resonators.

9. The dielectric resonator apparatus, as claimed in claim 8, wherein said at least one coupling groove and a second coupling groove are formed in opposite portions of said crossing portion.

10. The dielectric resonator apparatus, as claimed in claim 6, wherein each said dielectric resonator is shaped as a substantially regular rectangular prism.

11. A high-frequency band-pass filter apparatus comprising:

first and second cross-shaped TM dual mode dielectric resonators, each provided in an electrically conductive case, each said TM dual mode dielectric resonator comprising first and second dielectric resonators integrally formed so as to be perpendicular to each other, an operation mode of said first dielectric resonator being coupled with an operation mode of said second dielectric resonator through a mode coupling structure formed in each said TM dual mode dielectric resonator;

first and second coupling loops provided in said case so that said first coupling loop is magnetically coupled to said second dielectric resonator of said first TM dual mode dielectric resonator and said second coupling loop is magnetically coupled to said second dielectric resonator of said second TM dual mode dielectric resonator; and a partition plate of metal material having a plurality of slits formed therein so as to be parallel to said second dielectric resonators of said first and second TM dual mode dielectric resonators, said slits being provided for magnetically coupling said first dielectric resonator of said first TM dual mode dielectric resonator with said first dielectric resonator of said second TM dual mode dielectric resonator, wherein respective dimensions of said first and second dielectric resonators are different from each other in response to said magnetic coupling between said first and second coupling loops and said corresponding resonators, so that resonance frequencies of said second dielectric resonators of said first and second TM dual mode dielectric resonators are equal to those of said first dielectric resonators thereof, wherein said dimensions are thicknesses of said first and second dielectric resonators; and wherein each of said first and second resonators has an elongated shape and two ends, and each of said first and second resonators respectively, has a substantially constant thickness and a substantially constant width from end to end.

12. The high-frequency band-pass filter apparatus, as claimed in claim 11, wherein said mode coupling structure is a mode coupling means.

13. The high-frequency band-pass filter apparatus, as claimed in claim 11, wherein said mode coupling structure comprises at least one coupling groove formed in a crossing portion of said first and second dielectric resonators.

14. The high-frequency band-filter apparatus, as claimed in claim 13, wherein said at least one coupling groove and a second coupling groove are formed in opposite portions of said crossing portion.

15. The high-frequency band-pass filter apparatus, as claimed in claim 11, wherein each said dielectric resonator is shaped as a substantially regular rectangular prism.

16. A high-frequency band-pass filter apparatus comprising:

first and second cross-shaped TM dual mode dielectric resonators, each provided in an electrically conductive case, each said TM dual mode dielectric resonator comprising first and second dielectric resonators integrally formed so as to be perpendicular to each other, an operation mode of said first dielectric resonator being coupled with an operation mode of said second dielectric resonator through a mode coupling structure formed in each said TM dual mode dielectric resonator;

first and second coupling loops provided in said case so that said first coupling loop is magnetically coupled to said second dielectric resonator of said first TM dual mode dielectric resonator and said second coupling loop is magnetically coupled to said second dielectric resonator of said second TM dual mode dielectric resonator; and a partition plate of metal material having a plurality of slits formed therein so as to be parallel to said second dielectric resonators of said first and second TM dual mode dielectric resonators, said slits being provided for magnetically coupling said first dielectric resonator of said first TM dual mode dielectric resonator with said first dielectric resonator of said second TM dual mode dielectric resonator, wherein respective dimensions of said first and second dielectric resonators are different from each other in response to said magnetic coupling between said first and second coupling loops and said corresponding resonators, so that resonance frequencies of said second dielectric resonators of said first and second TM dual mode dielectric resonators are equal to those of said first dielectric resonators thereof, wherein said dimensions are widths of said first and second dielectric resonators; and wherein each of said first and second resonators has an elongated shape and two ends, and each of said first and second resonators respectively, has a substantially constant thickness and a substantially constant width from end to end.

17. The high-frequency band-filter apparatus, as claimed in claim 16, wherein said mode coupling structure comprises at least one coupling groove formed in a crossing portion of said first and second dielectric resonators.

18. The high-frequency band-filter apparatus, as claimed in claim 17, wherein said at least one coupling groove and a second coupling groove are formed in opposite portions of said crossing portion.

19. The high-frequency band-pass filter apparatus, as claimed in claim 16, wherein each said dielectric resonator is shaped as a substantially regular rectangular prism.

20.The high-frequency band-pass filter apparatus, as claimed in claim 16, wherein said mode coupling structure is a mode coupling means.

* * * * *